US006773272B2

(12) United States Patent
Koehler et al.

(10) Patent No.: US 6,773,272 B2
(45) Date of Patent: Aug. 10, 2004

(54) ELECTRICAL CONNECTOR ASSEMBLY AND MODULE INCORPORATING THE SAME

(75) Inventors: David F. Koehler, Lake Orion, MI (US); Jeffrey S. Campbell, West Bloomfield, MI (US)

(73) Assignee: Molex Incorporated, Lisle, IL (US)

( * ) Notice: Subject to any disclaimer, the term of this patent is extended or adjusted under 35 U.S.C. 154(b) by 97 days.

(21) Appl. No.: 10/131,872

(22) Filed: Apr. 22, 2002

(65) Prior Publication Data

US 2003/0199195 A1 Oct. 23, 2003

(51) Int. Cl.[7] ..... H01R 9/09
(52) U.S. Cl. ..... 439/79; 439/620
(58) Field of Search ..... 439/79, 80, 620, 439/76.1

(56) References Cited

U.S. PATENT DOCUMENTS 4,047,242 A * 9/1977 Jakob et al.
4,397,513 A * 8/1983 Clark et al.
5,112,233 A * 5/1992 Lybrand ..... 439/79
5,934,913 A * 8/1999 Kodama ..... 439/577
6,375,478 B1 * 4/2002 Kikuchi ..... 439/79
6,459,042 B1 * 10/2002 Stilianos ..... 174/138 G

* cited by examiner

*Primary Examiner*—Neil Abrams
(74) *Attorney, Agent, or Firm*—Stacey E. Caldwell

(57) ABSTRACT

A right-angled electrical connector assembly is provided for connection to a printed circuit board. The assembly includes a terminal support member for supporting the assembly on an appropriate support structure such as a chassis of a right-angled electrical connector module. A plurality of right-angled conductive terminals have compliant pin portions and generally perpendicular contact portions. The pin portions have retention portions. A terminal pin alignment member is supported on the support member and includes a plurality of pin-receiving passages for receiving the pin portions of the terminals therethrough in a direction generally perpendicular to the support member for connection to the printed circuit board. The passages have retention sections for engaging the retention portions of the terminals. A contact alignment member has a plurality of contact-receiving passages for receiving the contact portions of the terminals therethrough to define a mating portion of the assembly.

40 Claims, 13 Drawing Sheets

ELECTRICAL CONNECTOR ASSEMBLY AND MODULE INCORPORATING THE SAME

FIELD OF THE INVENTION

This invention generally relates to the art of electrical connectors and, particularly, to a right-angled electrical connector module incorporating one or more right-angled electrical connector assemblies.

BACKGROUND OF THE INVENTION

Generally, a typical electrical connector includes some form of dielectric or insulating housing mounting a plurality of conductive terminals. For instance, the housing may be molded of plastic material and the terminals may be stamped and formed of sheet metal material. The housing has a plurality of terminal-receiving passages into which the terminals are inserted so that contact portions of the terminals are exposed for engaging the contact portions of the terminals of a complementary mating connector or other connecting device.

A typical electrical connector has a front mating end or face at which the contact portions of the terminals are exposed, and a rear terminating end or face at which terminating portions of the terminals are located. The terminal-receiving passages extend generally between the mating and terminating ends of the connector housing. The rear terminating portions of the terminals are connected to a variety of conductors ranging from discrete electrical wires to circuit traces on a printed circuit board.

A header connector is a connector of the type described above wherein the connector housing is adapted for use in conjunction with a printed circuit board. The terminals of a header connector typically are pin-type terminals or terminals which have pin portions for insertion into appropriate holes in the printed circuit board which typically is mounted at the rear terminating end or face of the connector housing. The terminal pins often are bent at right-angles for insertion into the circuit board, whereby the front mating end or face of the connector housing projects generally parallel to the circuit board. The terminal pins often are "compliant" pins whereby they are forced into the holes in the printed circuit board to establish an interference or press fit within the holes.

Such header connectors may be mounted in an electrical connector module, such as a control box or module for various applications. One example is an air bag module for automotive or vehicular applications. With a control module or box, one or more header connector assemblies are mounted within the control box and are terminated to a printed circuit board housed therewithin. The header connectors typically are right-angled connectors, and the terminals are right-angled terminals having terminating ends for connection to the circuit traces on the printed circuit board, and contact ends of the terminals project through the control box at a mating end or side thereof for electrical connection to complementary mating connectors. A sealant is often used to cover the box to protect the printed circuit board. This module and assembly process is costly and inefficient. Costs and inefficiency increases when the solder-tail ends of the terminals are made to be compliant pins or tails which are forced into holes in the circuit board, because there are no means for supporting the compliant pins when the circuit board is installed.

With the ever-increasing miniaturization of electrical connectors due to the ever-increasing density of the circuits in electronic applications, a myriad of additional problems have been encountered in fabricating and assembling electrical connectors as described above, such as header connectors having compliant pins for insertion into holes in a printed circuit board. To begin with, because of the miniaturization of the connector assembly, itself, the conductive terminals, such as stamped and formed sheet metal terminals, are extremely small, fragile and practically impossible to maintain at proper spacing or pitch. Consequently, pin alignment plates have been used for passing the terminal pins therethrough to maintain proper relative positioning of the terminal pins. If compliant pins are used as stated above, some form of mechanical support must be provided during assembly as the pins are forced into the holes in the printed circuit board. Still further, if the compliant pins are at right angles in an angled connector assembly, support of the terminal pins is difficult and unreliable. Typical alignment plates simply do not provide sufficient retention strength to force a large number of compliant pins into the holes of the printed circuit board. Therefore, support fixtures such as steel tooling must be used to support the alignment plate and compliant pins during assembly to the printed circuit board. This metal fixture typically looks like an elongated comb for insertion between rows of the terminal pins. Unfortunately, it is desirable in many applications to stagger the terminal pins in adjacent rows thereof. Consequently, such comb-like supporting fixtures cannot even be used because the staggered pins do not provide adequate passageways for the pin projections of the comb support.

This intertwined series of problems has made it extremely difficult to fabricate and/or assemble header connectors, such as right-angled header connectors, and particularly connectors which use compliant pins which are assembled to printed circuit boards, and still further when the header connectors are used in electrical connector modules or control boxes. The present invention is directed to a unique electrical connector assembly and a connector module incorporating such an assembly, to avoid or eliminate most if not all of these numerous problems.

SUMMARY OF THE INVENTION

An object, therefore, of the invention is to provide a new and improved right-angled electrical connector assembly for connection to a printed circuit board.

Another object of the invention is to provide a new and improved electrical connector module or control box incorporating the connector assembly of the invention.

In the exemplary embodiment of the invention, a right-angled electrical connector assembly is provided for connection to a printed circuit board. The assembly includes a terminal support member for supporting the assembly on an appropriate support structure. A plurality of right-angled conductive terminals have compliant pin portions and generally perpendicular contact portions, the pin portions having retention portions. A terminal pin alignment member is provided on the support member and includes a plurality of pin-receiving passages for receiving the pin portions of the terminals therethrough in a direction generally perpendicular to the support structure for connection to the printed circuit board. The passages have retention sections for engaging the retention portions of the terminals. A contact alignment member has a plurality of contact-receiving passages for receiving the contact portions of the terminals therethrough to define a mating portion of the assembly.

In one embodiment of the invention, the terminal pin alignment member is an integral part of the terminal support member as a one-piece component. At least one mounting post projects upwardly therefrom for mounting the printed circuit board thereon.

In another embodiment of the invention, the terminal pin alignment member is separate from the terminal support member and is supported thereon. The support member includes at least one dual-diameter mounting post. A larger diameter portion of the mounting post is insertable through a mounting hole in the terminal pin alignment member. A smaller diameter portion of the mounting post is insertable into an appropriate mounting hole in the printed circuit board.

Another feature of the invention is providing the terminal support member with receptacle means for receiving an electrical component, such as a capacitor. Conductive leads extend from the receptacle toward the printed circuit board. The leads include pin portions for insertion into appropriate holes in the printed circuit board. The leads may also include insulation displacement portions for engaging conductors from the electrical component.

The right-angled electrical connector assembly is shown herein mounted in a right-angled electrical connector module, such as a control box used as an air bag module in automotive or vehicular applications. In that context, the module generally includes a chassis having a base and a mating portion extending generally parallel to the base. The terminal support member of the connector assembly is supported on the base of the chassis. The contact portions of the terminals extend into the mating portion of the chassis.

More particularly, the chassis shown herein comprises a box-like structure having a bottom wall and side walls. The terminal support member is supported on the bottom wall. The mating portion of the chassis is at a side wall of the box-like structure. A cover also may be provided for the box-like structure.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
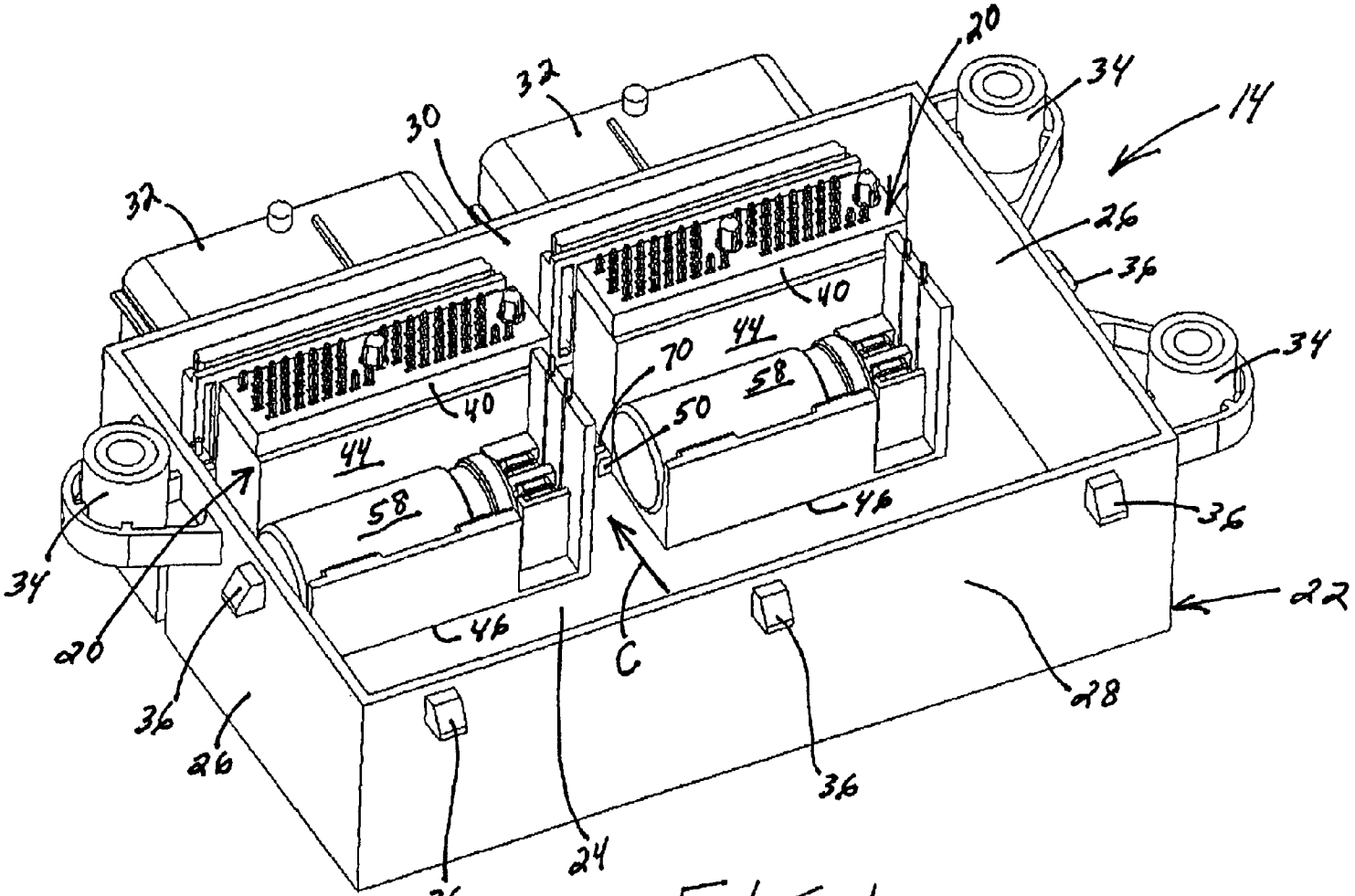
FIG. 1 is a rear perspective view of a first embodiment of a right-angled electrical connector module incorporating two right-angled electrical connector assemblies according to the invention, and with the cover of the module removed to show the connector assemblies therewithin.

Referring to the drawings in greater detail, and first to the embodiment of FIG. 1, the invention is embodied in a right-angled electrical connector module, generally designated 14. The module is in the form of a "control box" which can be used for various applications such as an air bag module for automotive or vehicular applications. The module also includes a printed circuit board 16 shown in FIG. 9 as well as a cover 18 shown in FIG. 10. As an air bag module or control box, module 14, including printed circuit board 16, would control all of the functions of a plurality of air bags in a vehicle.

Still referring to FIG. 1, module 14 is a right-angled electrical connector module and mounts two right-angled electrical header connector assemblies, generally designated 20 therewithin. The module includes a chassis, generally designated 22, in the form of a box-like structure having a base or bottom wall 24, a pair of opposite side walls 26, a rear side wall 28 and a front side wall 30. The box-like chassis may be molded of plastic material. A pair of mating portions 32 project forwardly of front wall 30. The mating portions are generally hollow and define shrouds or receptacles for receiving a pair of complementary mating connectors (not shown). A plurality of mounting bosses 34 project outwardly from opposite side walls 26 for securing module 14 wherever the module is to be used, such as to a frame component of an automobile or other vehicle. A plurality of chamfered latch bosses 36 project outwardly from opposite side walls 26 and rear wall 28.

Figure 2:
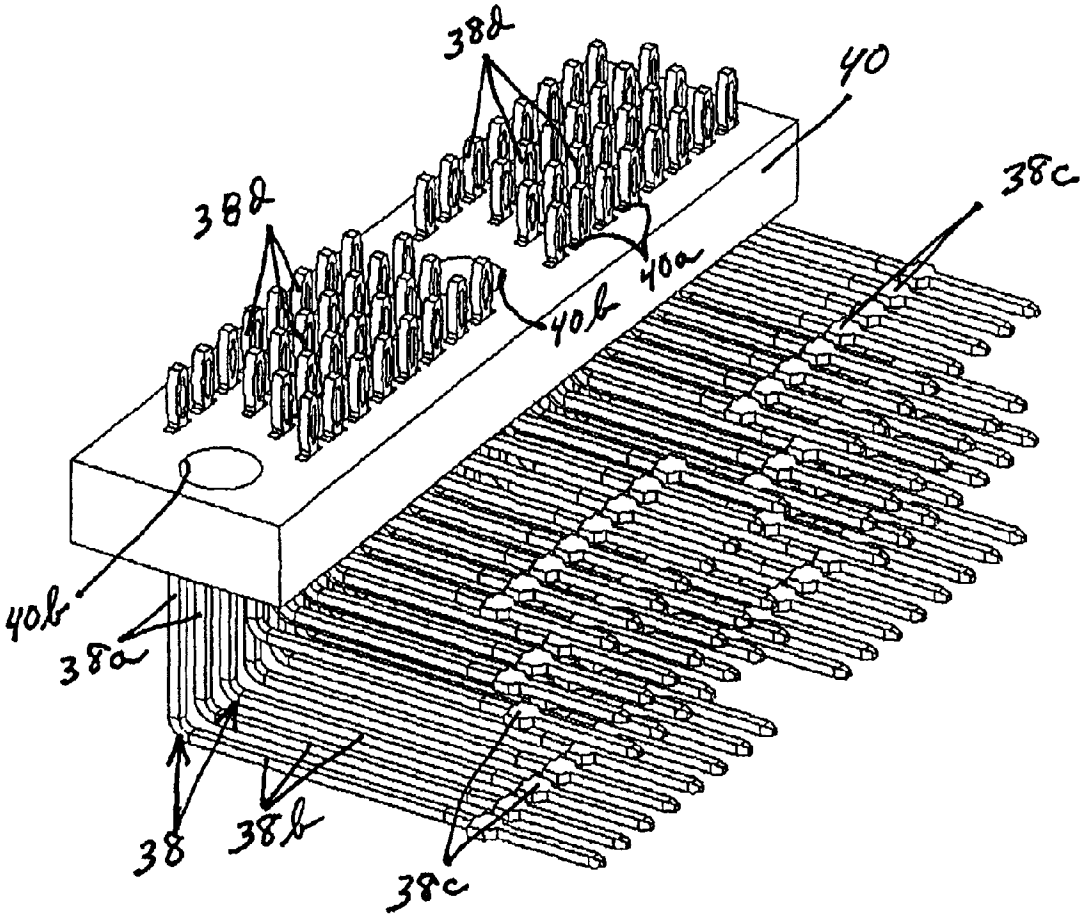
FIG. 2 is a perspective view of a plurality of right-angled terminals inserted into a terminal pin alignment plate of one of the connector assemblies in the embodiment of FIG. 1.
Figure 9:
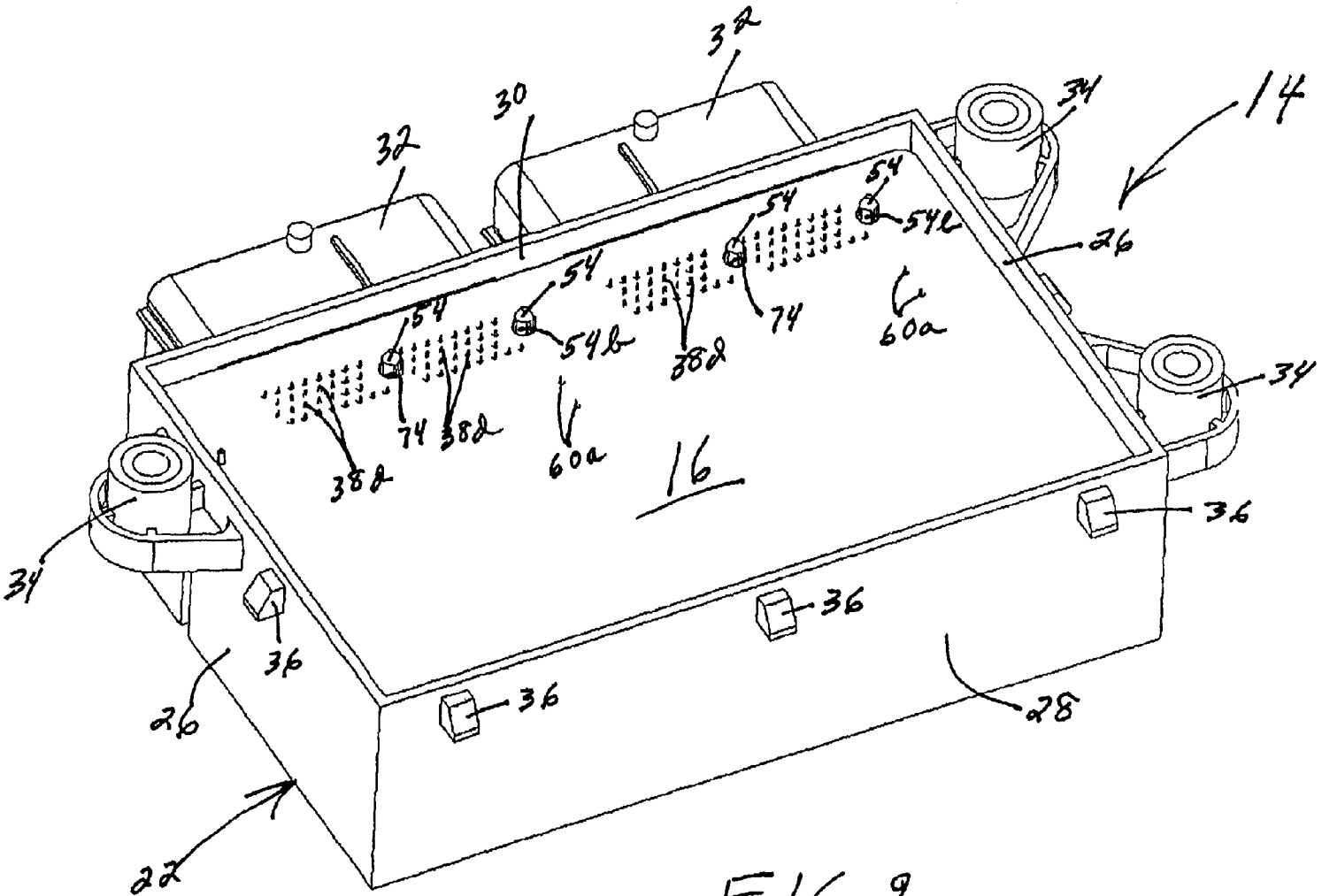
FIG. 9 is a view similar to that of FIG. 1, with a printed circuit board terminated within the control box.

Each header connector assembly 20 (FIG. 1) includes a plurality of right-angled conductive terminals, generally designated 38, as best seen in FIG. 2. The terminals include pin portions 38*a* and generally perpendicular contact portions 38*b*. The contact portions have enlarged retention sections or portions 38*c*. In FIG. 2, pin portions 38*a* have compliant distal ends 38*d* which will be forced into appropriate plated-through holes in printed circuit board 16 as seen in FIG. 9. Distal ends 38*d* are made "compliant" by forming apertures therethrough so that the sides of the distal ends are somewhat flexible due to the apertures. Conductive terminals 38 may be stamped and formed of conductive sheet metal material.

Still referring to FIG. 2, each header connector assembly 20 (FIG. 1) includes a terminal pin alignment member or plate 40 having a plurality of pin-receiving passages 40*a* therethrough. A pair of mounting holes 40*b* also are formed through the pin alignment plate. The alignment plate is fabricated of dielectric material such as plastic or the like.

Figure 3:
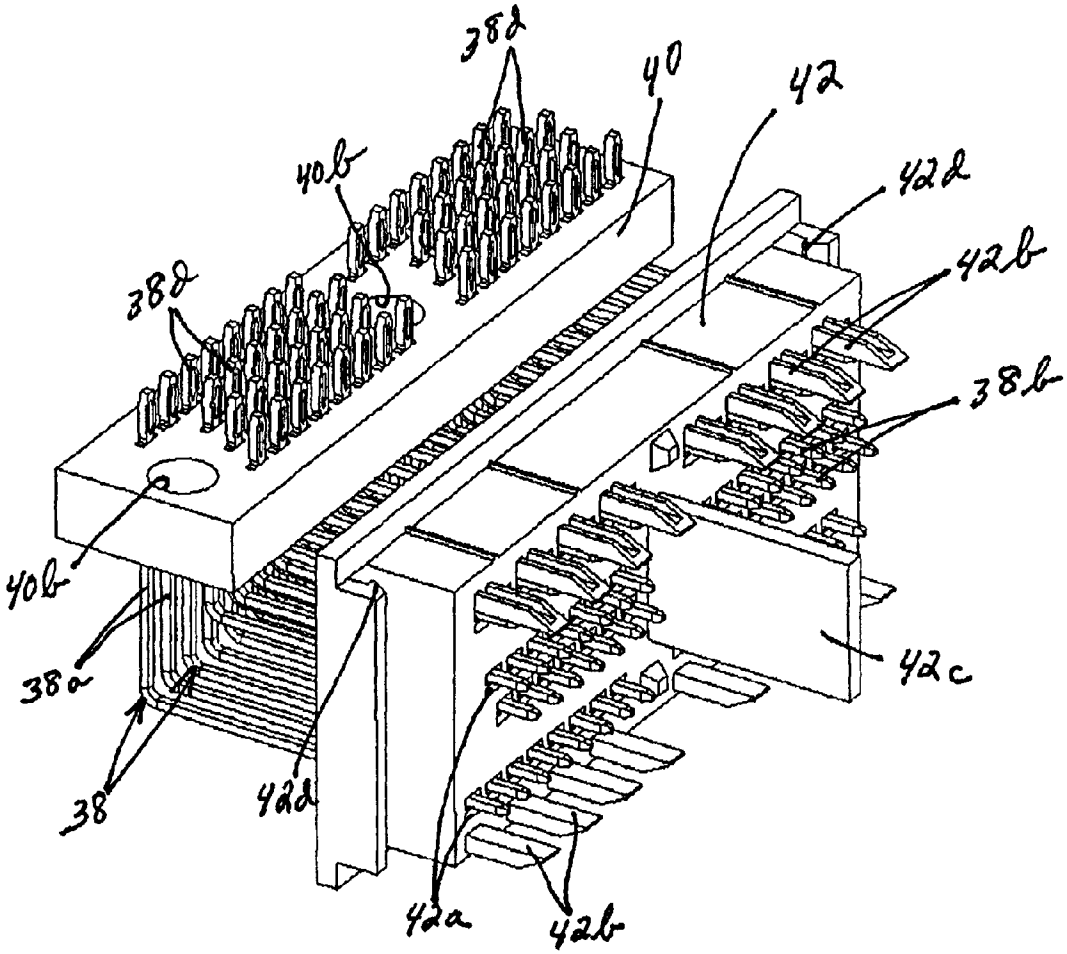
FIG. 3 is a view similar to that of FIG. 2, with the contact portions of the terminals inserted through a contact alignment plate of the assembly.

Referring next to FIG. 3, each header connector assembly 20 (FIG. 1) includes a contact alignment member or plate 42 having a plurality of contact-receiving passages 42*a* therethrough and through which contact portions 38*b* of terminal 38 extend. The contact alignment plate is fabricated of dielectric material such as plastic or the like. When contact portions 38*b* of the terminals are inserted through passages 42*a* in the contact alignment plate, enlarged retention portions 38*c* (FIG. 2) secure the contact portions of the terminals within the passages by skiving into the plastic material of which the alignment plate is fabricated. A plurality of actuating arms 42*b* project forwarding of contact alignment plate 42 in the mating direction. These actuating arms are effective to open a plurality of shorting contacts on the mating connector.

An orienting plate 42*c* is molded integrally with contact alignment plate 42 and also projects forwardly thereof in the mating direction. Orienting plate 42*c* is effective for preventing damage from occurring to the contact portions of the terminals and for insertion into a complementary slot in the mating connector to prevent the mating connector from mating with header connector 20 in an inappropriate orientation. Finally, a pair of latch flanges 42*d* are molded integrally with contact alignment plate 42 along opposite sides or ends thereof and project forwardly in the mating direction as can be seen in FIG. 3.

Figure 4:
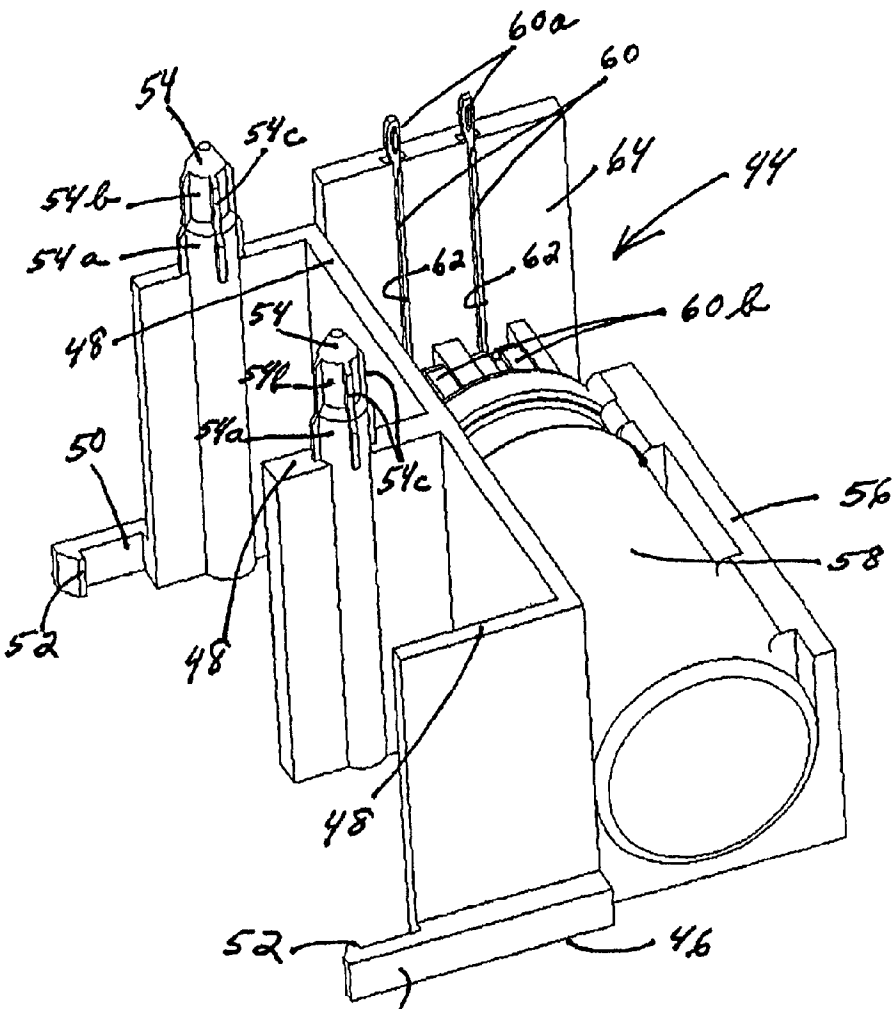
FIG. 4 is a perspective view of the terminal support member of the assembly.

Each right-angled header connector assembly 20 (FIG. 1) includes a terminal support member, generally designated 44 in FIG. 4. The support member is fabricated of dielectric material such as molded plastic or the like. The support member includes a bottom surface 46 for positioning on top of bottom wall 24 of chassis 22 as can be seen in FIG. 1. The support member has a top ledge 48 on top of which pin alignment plate 40 (FIGS. 2 and 3) is positioned within the assembly. A pair of guide ribs 50 project outwardly from opposite sides of the support member. The guide ribs are elongated in the horizontal or mating direction and terminate in a pair of inwardly directed latch hooks 52 at the front distal ends of the guide ribs. A pair of dual-diameter mounting posts 54 project upwardly from top ledge 48 of the support member. Each supporting post 54 has a larger diameter portion 54*a* and a smaller diameter portion 54*b*, for purposes described hereinafter. The latch posts also have "crush" ribs 54*c* spaced about the outer peripheral surface thereof.

Still referring to FIG. 4, terminal support member 44 may perform multiple functions within electrical connector module 14. To that end, a receptacle 56 is molded integrally with the support member for receiving an electrical component, such as a capacitor 58. A pair of conductive leads 60 are disposed within a pair of grooves 62 in an integrally molded, upstanding flange 64 of the support member. Leads 60 have compliant pin portions 60*a* at the distal ends thereof for insertion through appropriate holes in printed circuit board 16 as seen in FIG. 9, for connection to appropriate circuit traces on the printed circuit board. Leads 60 have insulation displacement portions 60*b* for engaging a pair of contacts from capacitor 58.

Figure 5:
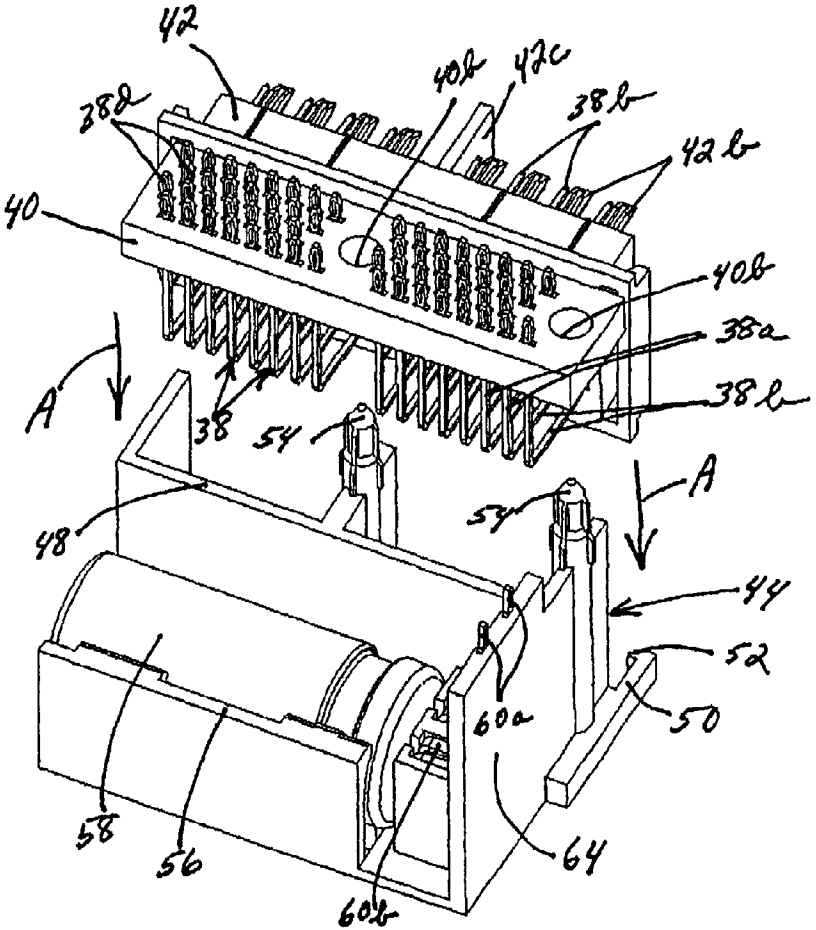
FIG. 5 is a perspective view showing the subassembly of FIG. 3 about to be mounted on the terminal support member of FIG. 4.
Figure 6:
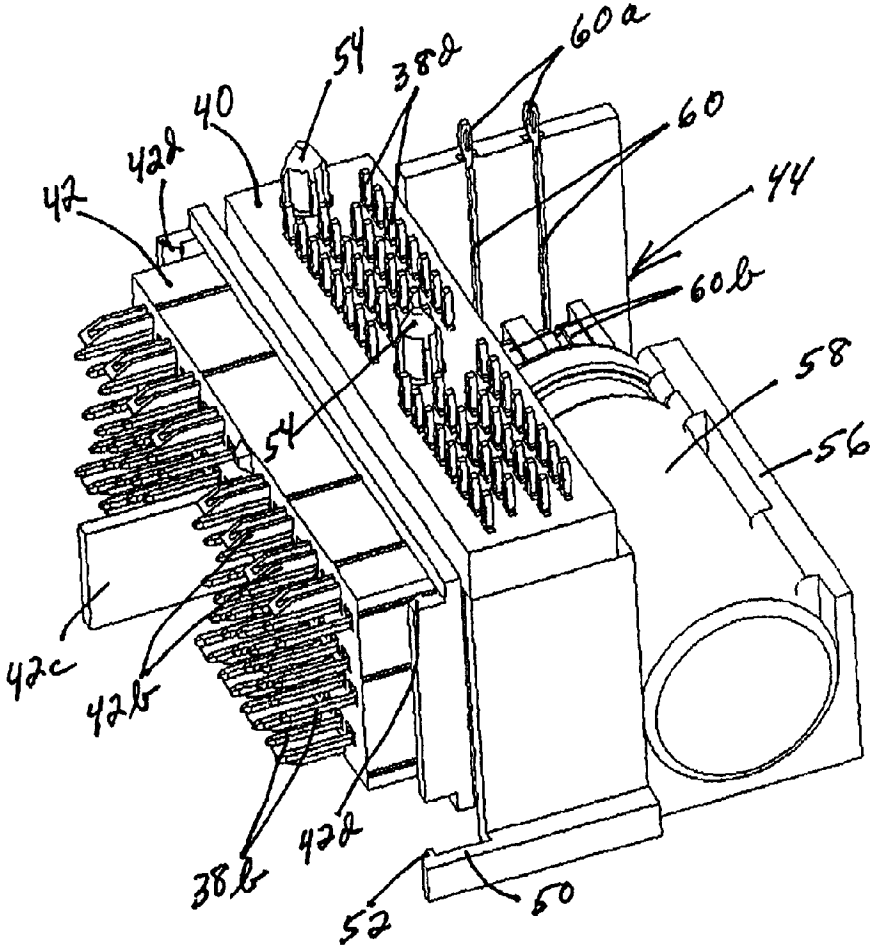
FIG. 6 is a view similar to that of FIG. 5, with the subassembly fully mounted on the terminal support member.

FIG. 5 shows the subassembly of FIG. 3 in the process of being mounted onto the top of support member 44 in the direction of arrows "A". FIG. 6 shows the subassembly fully mounted on top of the support member. When mounting the subassembly to the support member, mounting posts 54 of support member 44 are inserted into and through mounting holes 40*b* in terminal pin alignment plate 40. The terminal alignment plate is forced downwardly onto the larger diameter portions 54*a* (FIG. 4) of the mounting posts, crushing ribs 54*c* of the enlarged diameter portion to establish an interference fit of the mounting posts within the mounting holes so that the terminal pin alignment plate and terminals cannot be lifted off of the support member from the position shown in FIG. 6.

Figure 7:
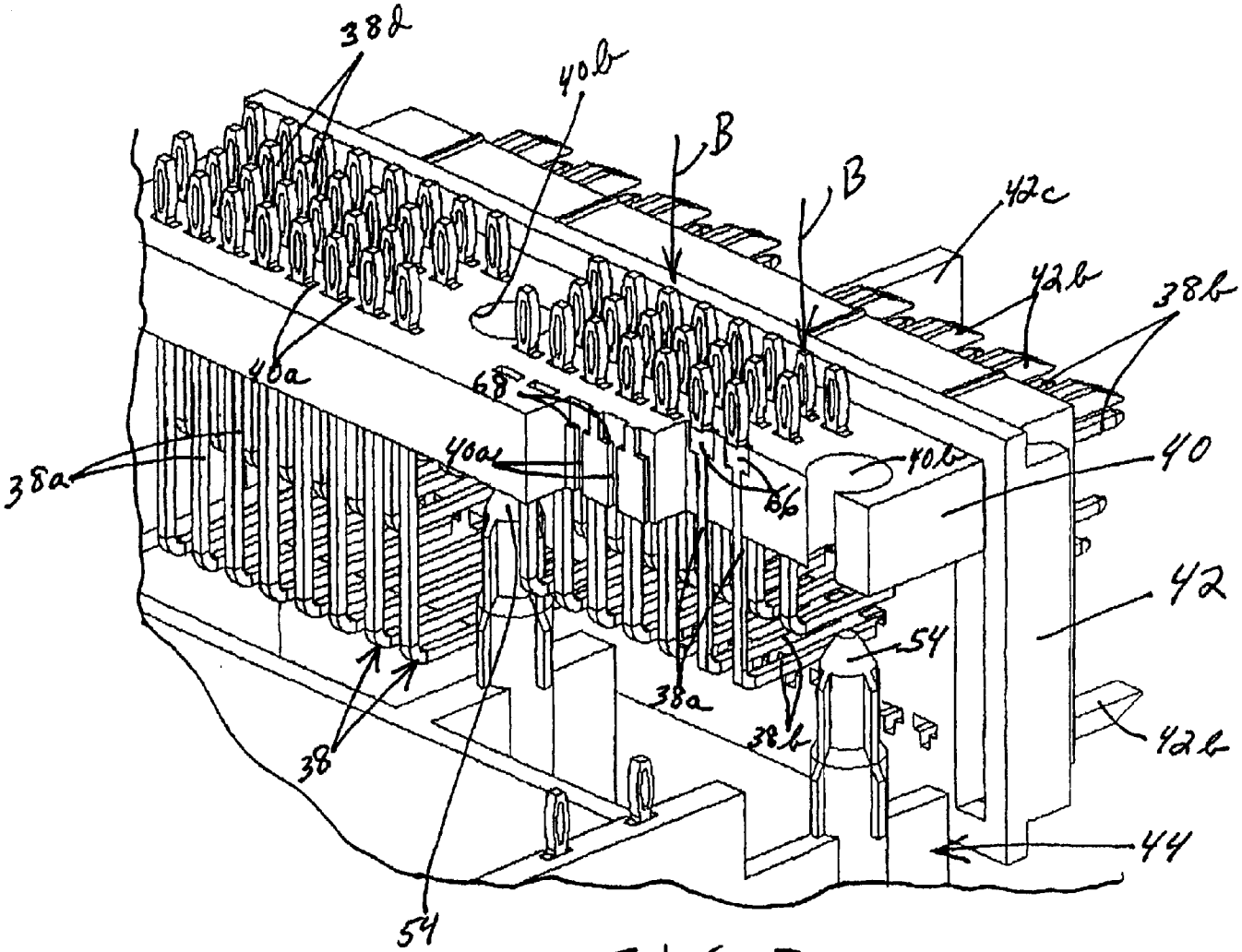
FIG. 7 is a fragmented enlarged perspective view showing the configuration of a few of the pin-receiving passages in the terminal pin alignment plate.

FIG. 7 shows that pin portions 38*a* of right-angled terminals 38 have enlarged retention portions 66 which abut against stop shoulders 68 formed within through passages 40*a* of terminal pin alignment plate 40. Therefore, when forces are applied to compliant distal ends 38*d* of the pin portions in the direction arrows "B" (FIG. 7), retention portions 66 of the terminals abut against stop shoulders 68 within the passages through the terminal pin alignment plate which is rigidly backed-up by terminal pin support member 44. This occurs when printed circuit board 16 is installed as seen in FIG. 9.

Figure 8:
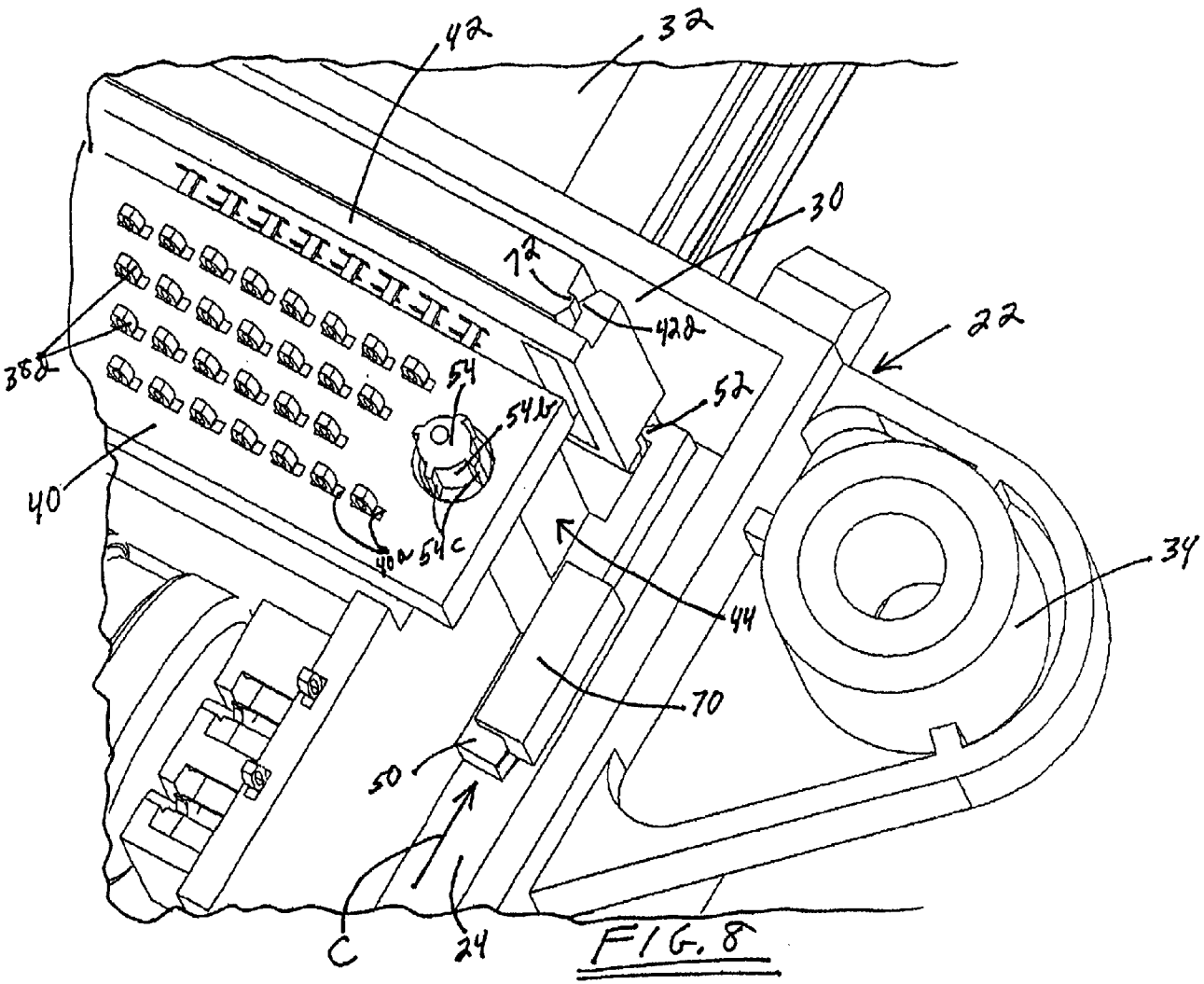
FIG. 8 is an enlarged fragmented perspective view showing the latch means between the contact alignment plate and the terminal support member with a latch flange on the chassis of the control box.

Header connector assemblies 20 are mounted within box-like chassis 22 (FIG. 1) by positioning the connector assemblies into the chassis at the rear thereof (i.e., immediately adjacent the inside of rear wall 28). The connector assemblies then are pushed forwardly in the direction of arrow "C" to slide guide ribs 50 (FIG. 4) beneath a plurality of guide flanges 70 fixed to or integral with bottom wall 24 of the chassis. FIG. 8 clearly shows one of the guide ribs having been moved in the direction of arrow "C" beneath one of the guide flanges 70 on bottom wall 24 of the chassis.

Connector assemblies 20 are moved forwardly until they abut against the rear of front wall 30 of the chassis as seen in FIGS. 1 and 8. A plurality of latch flanges 72 are fixed to or integral with the inside of front wall 30 as seen in FIG. 8. When the connector assemblies are pushed completely forwardly against front wall 30, latch flanges 42*d* of contact alignment plate 42 and latch hooks 52 of terminal support member 44 latchingly interengage with latch flanges 72 to hold header connector assemblies 20 within chassis 22 at the final assembly positions shown in FIG. 1.

After header connector assemblies 20 are moved to their final latched position within chassis 22, printed circuit board 16 is installed as shown in FIG. 9. The smaller diameter portions 54*b* of mounting posts 54 described above in relation to FIG. 4, are inserted through a plurality of mounted holes 74 in the printed circuit board. During insertion, crush ribs 54*c* (FIG. 4) are deformed to establish a tight interference fit between the printed circuit board and the mounting posts. It can be seen that compliant pin portions 38*d* of terminals 38, as well as compliant pin portions 60*a* of leads 60 are inserted through appropriate holes in the printed circuit board for connection to circuit traces on the board and in the plated through holes in the board.

Figure 10:
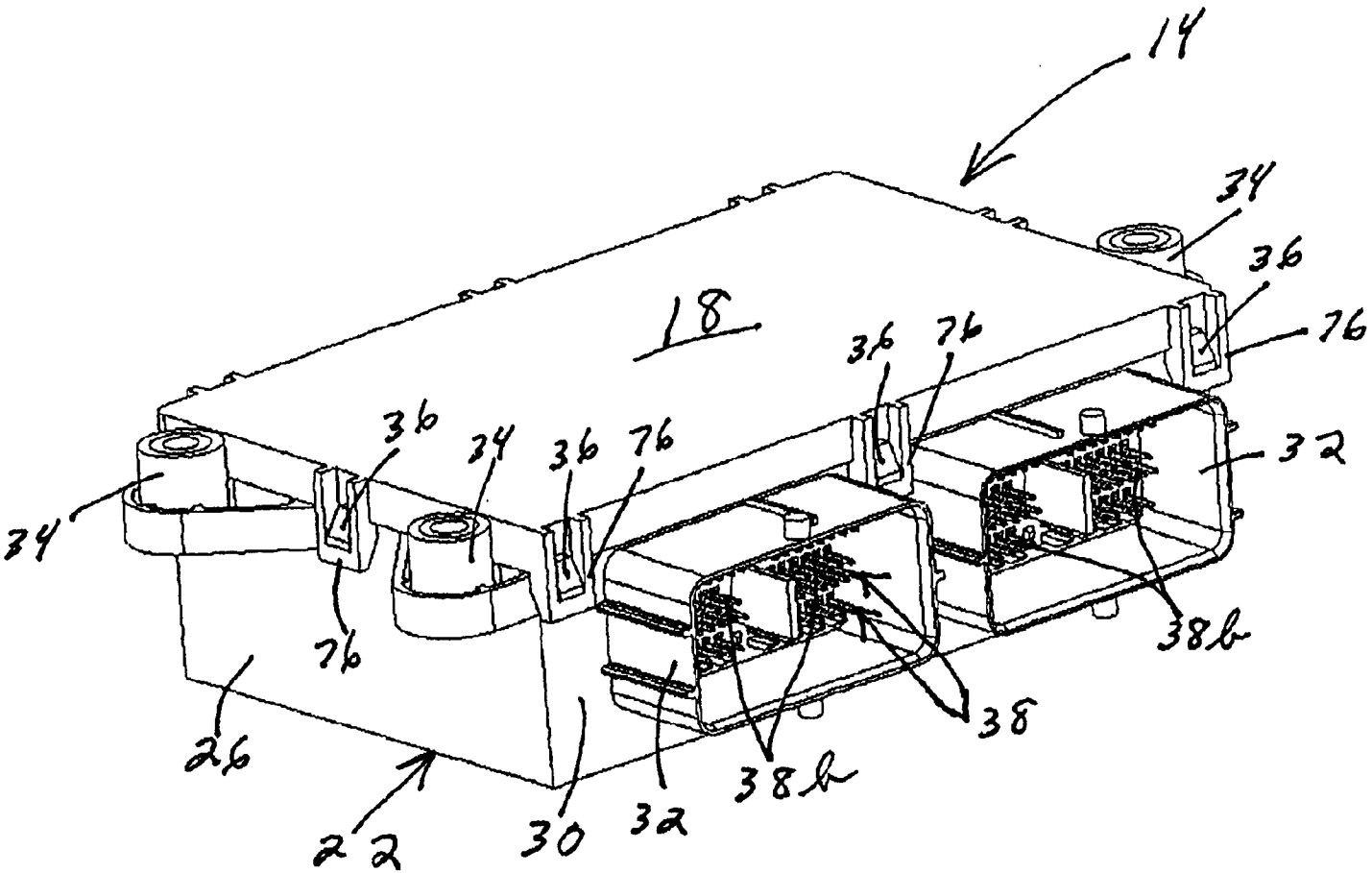
FIG. 10 is a view similar to that of FIGS. 1 and 9, turned 180°, and showing a cover for the entire connector module.

Finally, FIG. 10 shows cover 18 mounted on top of chassis 22 to enclose the header connector assemblies and the printed circuit board within electrical connector module or control box 14. The cover has a plurality of latches 76 which snap into latching engagement over chamfered latch bosses 36 about the periphery of chassis 22. It can be seen in FIG. 10 how contact portions 38*b* of terminal 38 project forwardly in the mating direction through front wall 30 and into mating portions 32 of the chassis. This protects the contact portions from damage during the mating sequence of the mating connector.

Figure 11:
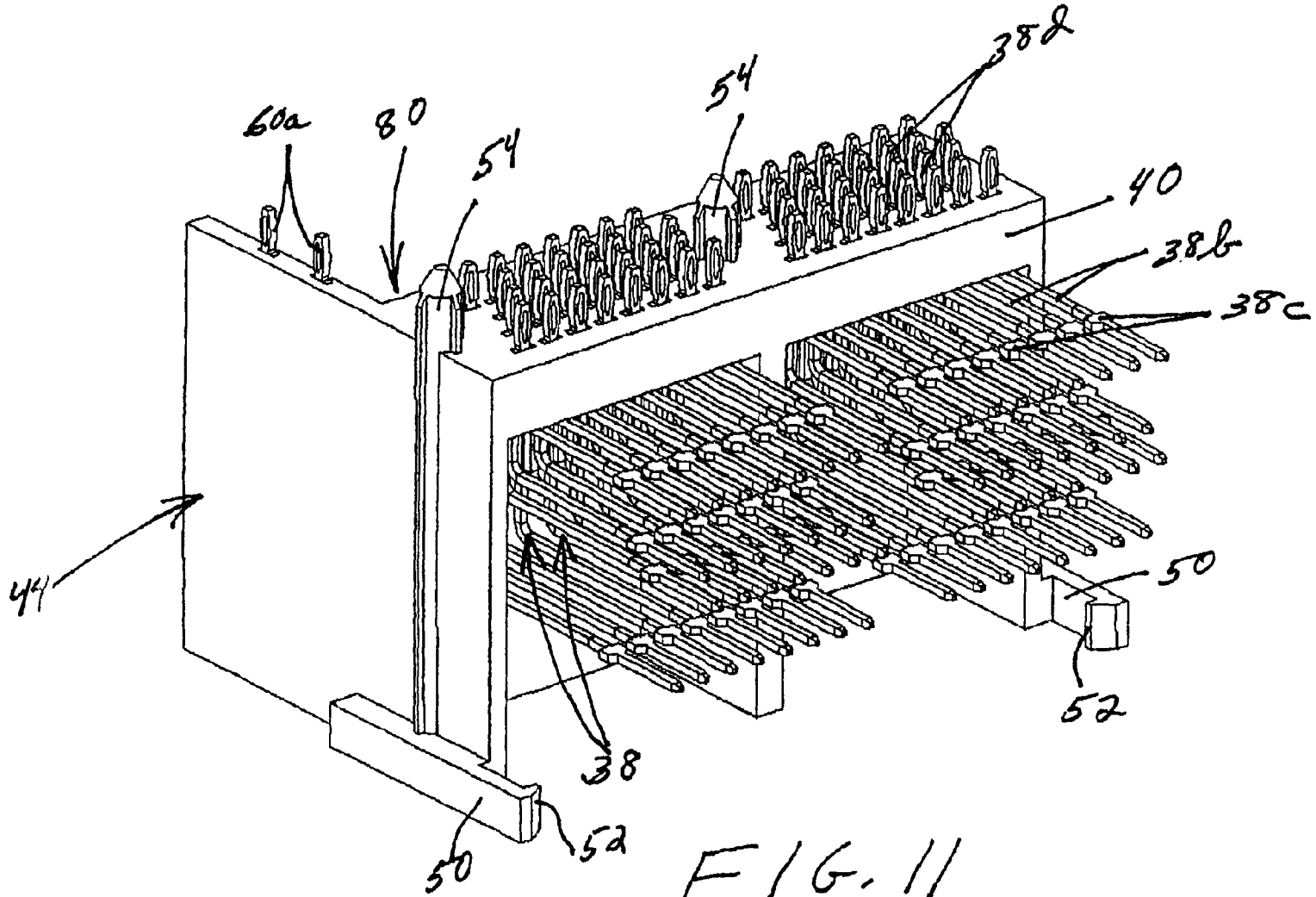
FIG. 11 is a perspective view of a one-piece terminal support member/terminal pin alignment plate of a second embodiment of the invention.
Figure 12:
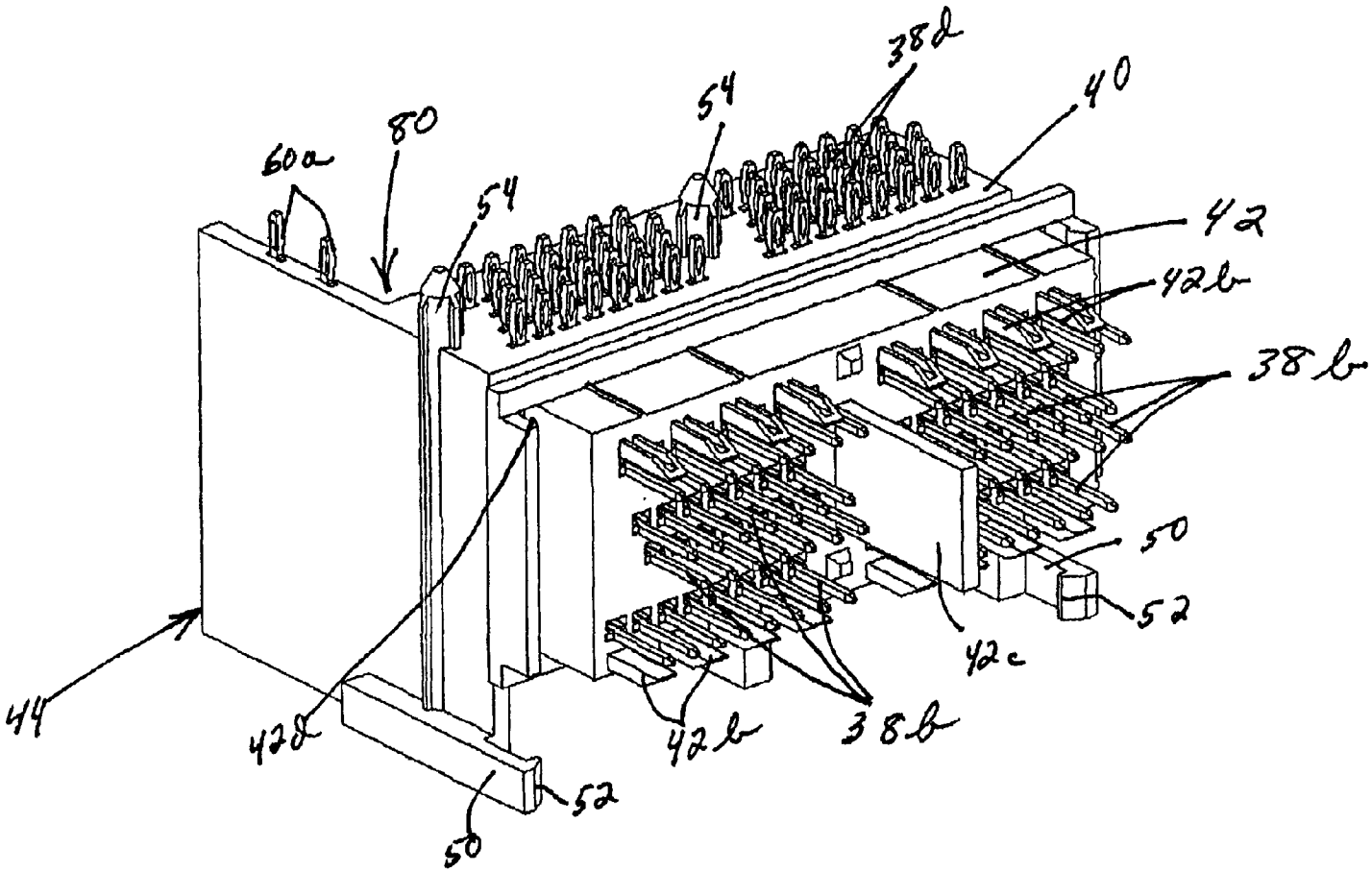
FIG. 12 is a view similar to that of FIG. 11, with the contact alignment plate added thereto.
Figure 13:
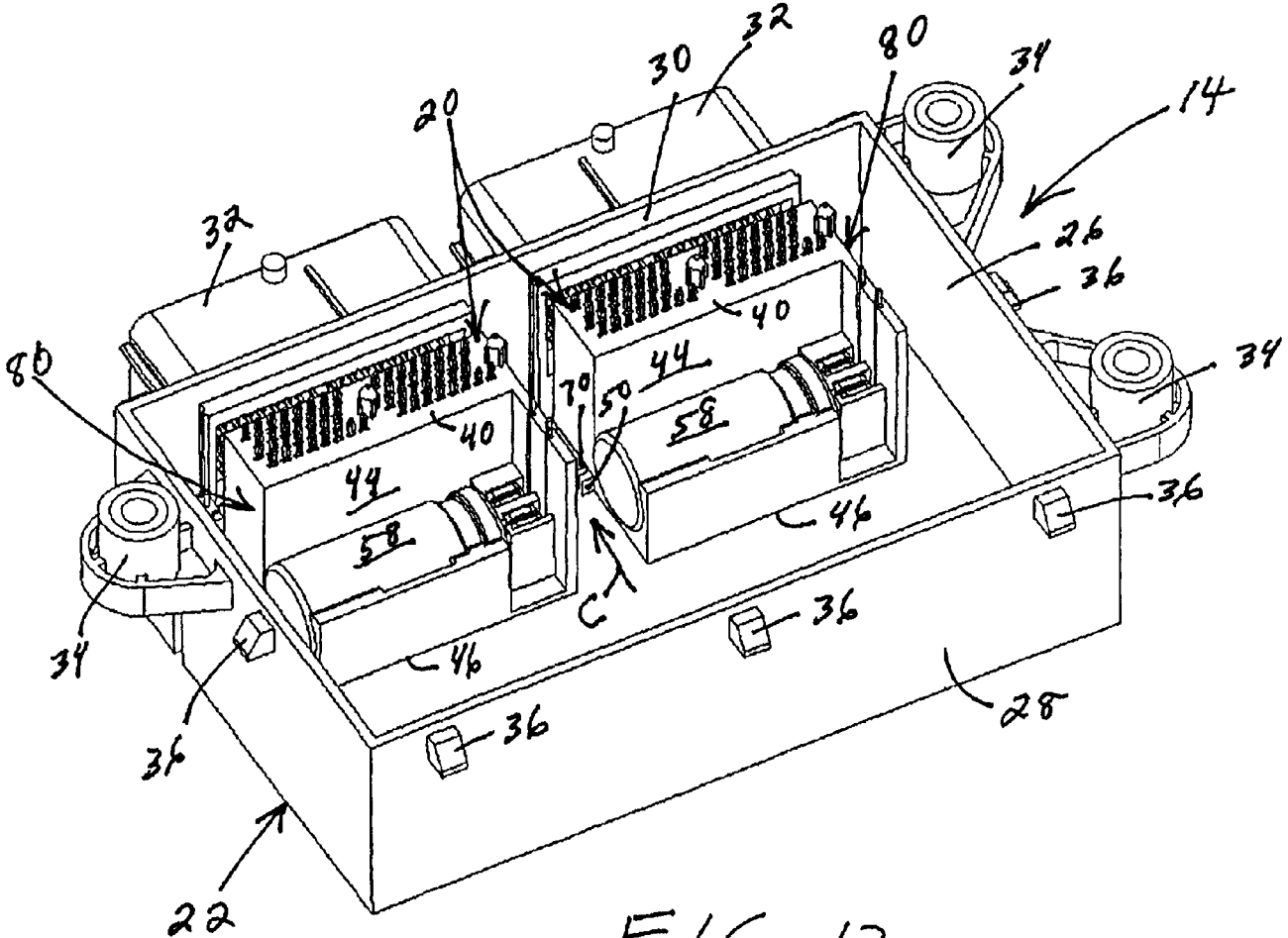
FIG. 13 is a view similar to that of FIG. 1, but incorporating the connector assemblies of the second embodiment.

FIGS. 11–13 show an alternative embodiment of the invention, and like reference numerals will be used in these drawings corresponding to like components described above in relation to the first embodiment of FIGS. 1–10. In particular, the second embodiment incorporates terminal pin alignment plate 40 and terminal support member 44 into an integral or one-piece component, generally designated 80. This can be done by molding the one-piece component of dielectric material such as plastic or the like. It can be seen in FIG. 11 that the right-angled terminal pins 38 are assembled to terminal alignment plate 40 the same as described above in relation to the first embodiment. It can be seen in FIG. 12 that contact alignment plate 42 is assembled to contact portions 38*b* of the terminals as described above in relation to the first embodiment. It can be seen in FIG. 13 that the header connector subassembly of FIG. 12 is assembled within chassis 22 the same as with the first embodiment described above. Other than the fact that terminal pin alignment plate 40 is integral with terminal support member 44, the resultant right-angled electrical connector module in its completed form is the same as described above in relation to the first embodiment of FIG. 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A right-angled electrical connector module, comprising:

a chassis including a base and a mating portion extending generally parallel to the base;

a terminal support member supported on the base of the chassis;

a terminal pin alignment member supported on the support member and including a plurality of pin-receiving passages having retention sections;

a plurality of right-angled conductive terminals having compliant pin portions and generally perpendicular contact portions, the pin portions being insertable through the passages in the pin alignment member and into appropriate holes in a printed circuit board, and the pin portions having retention portions for engaging the retention sections of the passages; and a contact alignment member having contact-receiving passages for receiving the contact portions of the conductive terminals, the contact alignment member being separate from and independent of the terminal pin alignment member and being positionable at the mating portion of the chassis.

2. The electrical connector module of claim 1 wherein said chassis comprises a box-like structure having a bottom wall and side walls, said terminal support member being supported on the bottom wall, and said mating portion being at a side wall.

3. The electrical connector module of claim 2, including a cover for said box-like structure.

4. The electrical connector module of claim 1, including mounting means on said terminal support member for mounting the printed circuit board thereon.

5. The electrical connector module of claim 4 wherein said mounting means include at least one mounting post on the terminal support member and extending through the terminal pin alignment member.

6. The electrical connector module of claim 1, including complementary interengaging latch means between said terminal support member and the chassis.

7. The electrical connector module of claim 1, including complementary interengaging latch means between said contact alignment member and the chassis.

8. The electrical connector module of claim 1 wherein said terminal pin alignment member comprises an integral part of said terminal support member as a one-piece component.

9. The electrical connector module of claim 1 wherein said terminal pin alignment member is separate from the terminal support member and is supported thereon.

10. The electrical connector module of claim 9 wherein said terminal support member includes at least one dual-diameter mounting post, with a larger diameter portion of the post being insertable through a mounting hole in the terminal pin alignment member, and a smaller diameter portion of the post being insertable into an appropriate mounting hole in the printed circuit board.

11. The electrical connector module of claim 1 wherein said terminal support member includes receptacle means for receiving an electrical component, and conductive leads extending from the receptacle toward the printed circuit board.

12. The electrical connector module of claim 11 wherein said leads include pin portions for insertion into appropriate holes in the printed circuit board.

13. The electrical connector module of claim 12 wherein said leads include insulation displacement portions for engaging conductors from the electrical component.

14. A right-angled electrical connector module, comprising:

a box-like chassis including a bottom wall and side walls with a mating portion at one side wall extending generally parallel to the bottom wall;

a terminal support member mounted on the bottom wall of the chassis;

a terminal pin alignment member supported on the support member and including a plurality of pin-receiving passages having retention sections;

a plurality of right-angled conductive terminals having compliant pin portions and generally perpendicular contact portions, the pin portions being insertable through the passages in the pin alignment member and into appropriate holes in a printed circuit board, and the pin portions having retention portions for engaging the retention sections of the passages;

a contact alignment member having contact-receiving passages for receiving the contact portions of the conductive terminals, the contact alignment member being positionable at the mating portion of the chassis;

at least one mounting post on the terminal support member and extending through the terminal pin alignment member for mounting the printed circuit board on top of the terminal pin alignment member in engagement with the pin portions of the terminals; and complementary interengaging latch means between at least one of the terminal support member or the contact alignment member and the chassis.

15. The electrical connector module of claim 14, including a cover for said box-like chassis.

16. The electrical connector module of claim 14 wherein said terminal pin alignment member comprises an integral part of said terminal support member as a one-piece component.

17. The electrical connector module of claim 14 wherein said terminal pin alignment member is separate from the terminal support member and is supported thereon.

18. The electrical connector module of claim 17 wherein said terminal support member includes at least one dual-diameter mounting post, with a larger diameter portion of the post being insertable through a mounting hole in the terminal pin alignment member, and a smaller diameter portion of the post being insertable into an appropriate mounting hole in the printed circuit board.

19. The electrical connector module of claim 14 wherein said terminal support member includes receptacle means for receiving an electrical component, and conductive leads extending from the receptacle toward the printed circuit board.

20. The electrical connector module of claim 19 wherein said leads include pin portions for insertion into appropriate holes in the printed circuit board.

21. The electrical connector module of claim 20 wherein said leads include insulation displacement portions for engaging conductors from the electrical component.

22. A right-angled electrical connector assembly for connection to a printed circuit board, comprising:

a terminal support member for supporting the assembly on an appropriate support structure;

a plurality of right-angled conductive terminals having compliant pin portions and generally perpendicular contact portions, the pin portions having retention portions;

a terminal pin alignment member supported on the support member and including a plurality of pin-receiving passages for receiving the pin portions of the terminals therethrough in a direction generally perpendicular to said support structure for connection to the printed circuit board, the passages having retention sections for engaging the retention portions of the terminals; and a contact alignment member having a plurality of contact-receiving passages for receiving the contact portions of the terminals therethrough to define a mating portion of the assembly, the contact alignment member being separate from and independent of the terminal pin alignment member.

23. The electrical connector assembly of claim 22, including mounting means on said terminal support member for mounting the printed circuit board thereon.

24. The electrical connector assembly of claim 23 wherein said mounting means include at least one mounting post on the terminal support member and extending through the terminal pin alignment member.

25. The electrical connector assembly of claim 23 wherein said terminal pin alignment member comprises an integral part of said terminal support member as a one-piece component.

26. The electrical connector assembly of claim 23 wherein said terminal pin alignment member is separate from the terminal support member and is supported thereon.

27. The electrical connector assembly of claim 26 wherein said terminal support member includes at least one dual-diameter mounting post, with a larger diameter portion of the post being insertable through a mounting hole in the terminal pin alignment member, and a smaller diameter portion of the post being insertable into an appropriate mounting hole in the printed circuit beard.

28. The electrical connector assembly of claim 23 wherein said terminal support member includes receptacle means for receiving an electrical component, and conductive leads extending from the receptacle toward the printed circuit beard.

29. The electrical connector assembly of claim 28 wherein said leads include pin portions for insertion into appropriate holes in the printed circuit board.

30. The electrical connector assembly of claim 29 wherein said leads include insulation displacement portions for engaging conductors from the electrical component.

31. A right-angled electrical connector module, comprising:

a chassis including a base and a mating portion extending generally parallel to the base;

a terminal support member supported on the base of the chassis;

a terminal pin alignment member supported on the support member and including a plurality of pin-receiving passages having retention sections;

a plurality of right-angled conductive terminals having compliant pin portions and generally perpendicular contact portions, the pin portions being insertable through the passages in the pin alignment member and into appropriate holes in a printed circuit beard, and the pin portions having retention portions for engaging the retention sections of the passages;

a contact alignment member having contact-receiving passages for receiving the contact portions of the conductive terminals, the contact alignment member being positionable at the mating portion of the chassis; and mounting means on said terminal support member for mounting the printed circuit board thereon, the mounting means including at least one mounting post on the terminal support member and extending through the terminal pin alignment member.

32. A right-angled electrical connector module, comprising:

a chassis including a base and a mating portion extending generally parallel to the base;

a terminal support member separate from and supported on the base of the chassis;

a terminal pin alignment member separate from and supported on the support member and including a plurality of pin-receiving passages having retention sections;

a plurality of right-angled conductive terminals having compliant pin portions and generally perpendicular contact portions, the pin portions being insertable through the passages in the pin alignment member and into appropriate holes in a printed circuit board, and the pin portions having retention portions for engaging the retention sections of the passages;

a contact alignment member having contact-receiving passages for receiving the contact portions of the conductive terminals, the contact alignment member being positionable at the mating portion of the chassis; and at least one dual-diameter mounting post on the terminal support member, with a larger diameter portion of the post being insertable through a mounting hole in the terminal pin alignment member, and a smaller diameter portion of the post being insertable into an appropriate mounting hole in the printed circuit board.

33. right-angled electrical connector module, comprising:

a chassis including a base and a mating portion extending generally parallel to the base;

a terminal support member supported on the base of the chassis;

a terminal pin alignment member supported on the support member and including a plurality of pin-receiving passages having retention sections;

a plurality of right-angled conductive terminals having compliant pin portions and generally perpendicular contact portions, the pin portions being insertable through the passages in the pin alignment member and into appropriate holes in a printed circuit board, and the pin portions having retention portions for engaging the retention sections of the passages;

a contact alignment member having contact-receiving passages for receiving the contact portions of the conductive terminals, the contact alignment member being positionable at the mating portion of the chassis; and receptacle means on the terminal support member for receiving an electrical component, and conductive leads extending from the receptacle means toward the printed circuit board.

34. The electrical connector module of claim 33 wherein said leads include pin portions for insertion into appropriate holes in the printed circuit board.

35. The electrical connector module of claim 34 wherein said leads include insulation displacement portions for engaging conductors from the electrical component.

36. A right-angled electrical connector assembly for connection to a printed circuit board, comprising:

a terminal support member for supporting the assembly on an appropriate support structure;

a plurality of right-angled conductive terminals having compliant pin portions and generally perpendicular contact portions, the pin portions having retention portions;

a terminal pin alignment member supported on the support member and including a plurality of pin-receiving passages for receiving the pin portions of the terminals therethrough in a direction generally perpendicular to said support structure for connection to the printed circuit board, the passages having retention sections for engaging the retention portions of the terminals;

a contact alignment member having a plurality of contact-receiving passages for receiving the contact portions of the terminals therethrough to define a mating portion of the assembly; and mounting means on said terminal support member for mounting the printed circuit board thereon, the mounting means including at least one mounting post on the terminal support member and extending through the terminal pin alignment member.

37. A right-angled electrical connector assembly for connection to a printed circuit board, comprising:

a terminal support member for supporting the assembly on an appropriate support structure;

a plurality of right-angled conductive terminals having compliant pin portions and generally perpendicular contact portions, the pin portions having retention portions;

a terminal pin alignment member separate from and supported on the support member and including a plurality of pin-receiving passages for receiving the pin portions of the terminals therethrough in a direction generally perpendicular to said support structure for connection to the printed circuit board, the passages having retention sections for engaging the retention portions of the terminals;

a contact alignment member having a plurality of contact-receiving passages for receiving the contact portions of the terminals therethrough to define a mating portion of the assembly; and mounting means on said terminal support member for mounting the printed circuit board thereon, the mounting means including at least one dual-diameter mounting post on the terminal support member, with a larger diameter portion of the post being insertable through a mounting hole in the terminal pin alignment member, and a smaller diameter portion of the post being insertable into an appropriate mounting hole in the printed circuit board.

38. A right-angled electrical connector assembly for connection to a printed circuit board, comprising:

a terminal support member for supporting the assembly on an appropriate support structure;

a plurality of right-angled conductive terminals having compliant pin portions and generally perpendicular contact portions, the pin portions having retention portions;

a terminal pin alignment member supported on the support member and including a plurality of pin-receiving passages for receiving the pin portions of the terminals therethrough in a direction generally perpendicular to said support structure for connection to the printed circuit board, the passages having retention sections for engaging the retention portions of the terminals;

a contact alignment member having a plurality of contact-receiving passages for receiving the contact portions of the terminals therethrough to define a mating portion of the assembly;

mounting means on said terminal support member for mounting the printed circuit board thereon; and receptacle means on the terminal support member for receiving an electrical component, and conductive leads extending from the receptacle toward the printed circuit board.

39. The electrical connector assembly of claim 38 wherein said leads include pin portions for insertion into appropriate holes in the printed circuit board.

40. The electrical connector assembly of claim 39 wherein said leads include insulation displacement portions for engaging conductors from the electrical component.

* * * * *